US005238143A

United States Patent [19]

Crighton

[11] Patent Number: 5,238,143

[45] Date of Patent: Aug. 24, 1993

[54] APPARATUS FOR DISPENSING FLAT ARTICLES

[75] Inventor: Adam J. Crighton, Dundee, Scotland

[73] Assignee: NCR Corporation, Dayton, Ohio

[21] Appl. No.: 924,261

[22] Filed: Aug. 3, 1992

[51] Int. Cl.[5] ..... B65H 3/00

[52] U.S. Cl. ..... 221/7; 221/1; 221/15; 221/21; 221/255; 221/258; 221/277; 271/902; 271/2

[58] Field of Search ..... 221/2, 7, 15, 21, 251, 221/255, 258, 277, 1; 271/277, 110, 114, 121, 122, 35, 902, 2

[56] References Cited

U.S. PATENT DOCUMENTS

| | | | |
|---|---|---|---|
| 4,572,498 | 2/1986 | Shiozawa . | |
| 4,717,043 | 1/1988 | Groover et al. | 221/7 |
| 4,915,369 | 4/1990 | Rutishauser | 271/35 |
| 4,993,587 | 2/1991 | Abe | 221/21 |
| 5,150,818 | 9/1992 | DeMoss | 221/255 |

FOREIGN PATENT DOCUMENTS

| | | |
|---|---|---|
| 0038175 | 11/1983 | European Pat. Off. . |
| 3133446 | 3/1983 | Fed. Rep. of Germany . |
| 2354273 | 1/1978 | France . |
| 57-189950 | 11/1982 | Japan . |

*Primary Examiner*—H. Grant Skaggs
*Attorney, Agent, or Firm*—Elmer Wargo

[57] ABSTRACT

An envelope dispensing module (10) for use in an ATM includes feed belts (26) for feeding the lowermost envelope (18') of a stack of envelopes (18) along a feed path (49) towards an exit slot (50). Pulse generating apparatus (54) includes a roller (62) which is urged into engagement with the underside of the lowermost envelope (18') as this envelope (18') is fed along the feed path (49). During such feeding movement, a sensor (68) associated with a timing disc (64) mounted for rotation with the roller (62) generates a series of timing pulses in response to rotation of the roller (62) due to its engagement with the lowermost envelope (18'). Electronic control circuitry is arranged to stop the feed belts (26) with the lowermost envelope (18') in its correctly presented position at the exit slot (50) in response to the control circuitry counting a predetermined number of timing pulses subsequent to the sensing of the leading edge of this envelope (18') by an exit sensor (78) positioned behind the exit slot (50).

12 Claims, 4 Drawing Sheets

APPARATUS FOR DISPENSING FLAT ARTICLES

BACKGROUND OF THE INVENTION

1Field of Invention

This invention relates to an apparatus for dispensing flat articles such as envelopes.

2. Background Information

This invention has application, for example, to a depository apparatus included in an automated teller machine (ATM) of the kind which is arranged to dispense currency notes, or accept a deposit of money, as may be required by a customer.

As is well known, in operation of an ATM of this kind, a user inserts a customer identifying card into the machine and then enters certain data (such as a personal identification number, type of transaction and quantity of money required or to be paid in) on one or more keyboards included in a user console of the machine. The machine will then process the transaction, dispense currency notes or accept a money deposit as may be requested, and return the card to the user as part of a routine operation. If money is to be deposited, the user typically inserts an envelope containing the money (cash and/or checks) through a deposit entry slot in the user console, and the depository apparatus of the ATM transports the envelope to, and deposits it in, a portable container included in the apparatus.

From Patent EP-0038175B, there is known a depository apparatus including an envelope dispenser for dispensing envelopes to customers for their use in making money deposits, the dispenser including feeding means for feeding envelopes one by one along a feed path from an internal magazine to a slot in a front panel of the apparatus. The dispenser includes first and second sensors which are positioned adjacent the front panel and which are spaced apart along the feed path. Each sensor is obscured and then again illuminated as the envelope moves by and then past the sensor. When the sensor furthest from the panel is again illuminated with the other sensor still obscured, the motor driving the feeding means is deactivated and the envelope is in the correct position for collection by a customer. This known envelope dispenser has the disadvantage that, if incorrect feeding of one or more envelopes takes place, there may be insufficient information available to enable the nature of the fault to be determined. For example, if two overlapping envelopes are fed to the slot in the front panel, the apparatus has no means for providing an indication that an incorrect double feed has taken place.

SUMMARY OF THE INVENTION

It is an object of this invention to provide an apparatus for dispensing flat articles such as envelopes which apparatus is of simple construction and which alleviates the disadvantage of the known depository referred to above.

According to a preferred embodiment of this invention, there is provided a combination comprising:

a panel having an exit slot therein;

moving means for moving a flat article from a storage bin to said exit slot; and a timing disc means positioned between said storage bin and said exit slot for monitoring the movement of said flat article in said ATM;

said timing disc means including a roller engaging said flat article to generate pulses indicative of the movement of said flat article from said storage bin towards said exit slot.

In another aspect of this invention, there is provided an apparatus for dispensing flat articles, comprising:

a storage bin for storing said flat articles, and an exit location;

a feed path between said storage bin and said exit location;

feed means for feeding said articles, one by one, along said feed path to said exit location;

roller means, including a roller for engaging a said flat article as said flat article is moved along said feed path;

pulse generating means, including said roller means to generate a series of successive pulses in response to rotation of said roller, said successive pulses being spaced apart by a time substantially equal to a predetermined angular rotation of said roller;

sensing means for sensing the passage of a leading edge of a said flat article past a predetermined location in said feed path; and control means for stopping the feeding of said flat article in response to the generation by said pulse generating means of a predetermined number of pulses subsequent to the sensing of the passage of said leading edge by said sensing means.

A preferred embodiment of this invention will now be described by way of example with reference to the following specification, claims, and drawing.

DETAILED DESCRIPTION OF THE PREFERRED EMBODIMENT

Figure 1:
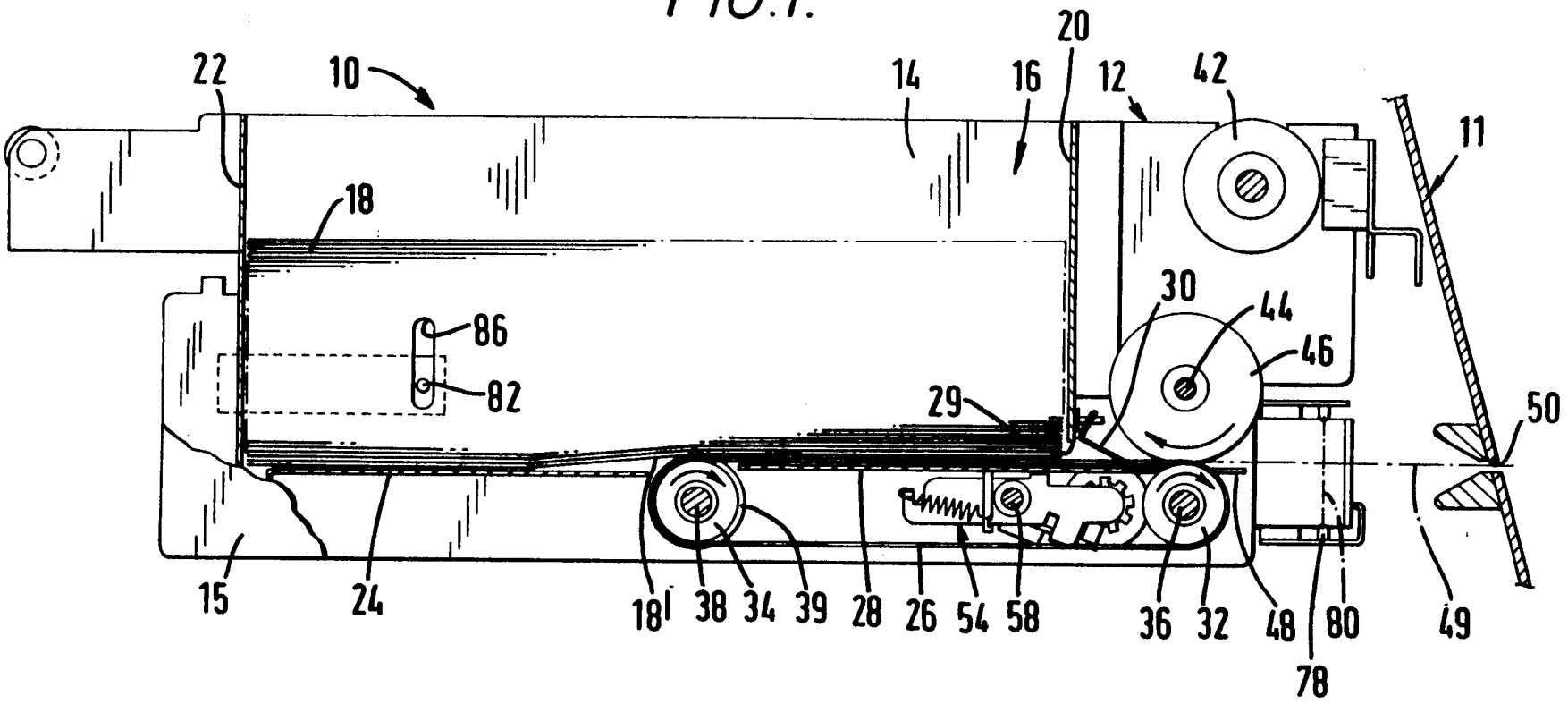
FIG. 1 is a side elevational view, shown partly broken away, of part of an ATM including an envelope dispensing module made in accordance with this invention.
Figure 2:
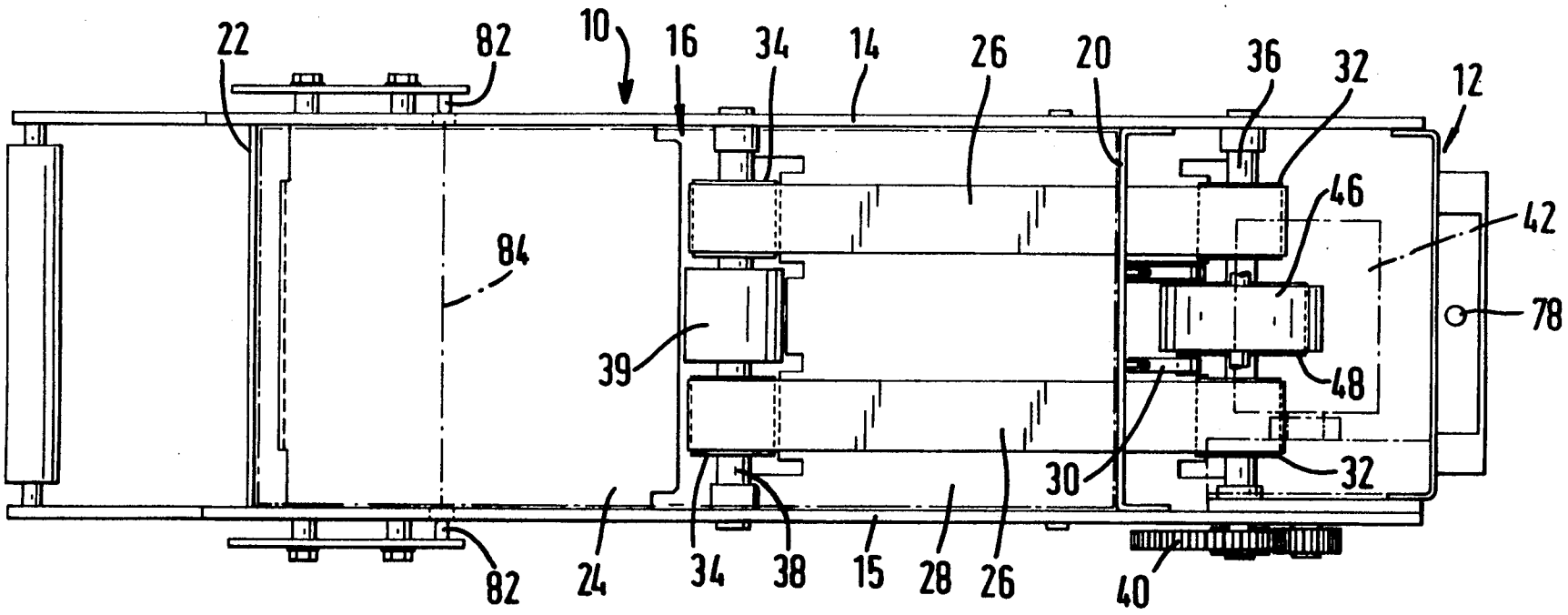
FIG. 2 is a plan view of the envelope dispensing module of FIG. 1.

Referring to FIGS. 1 and 2, an envelope dispensing module 10 shown therein forms part of an envelope depository (not otherwise shown) of an ATM having a user console 11 (not shown in FIG. 2), the module 10 being removably mounted in the ATM by means not shown. The module 10 includes a supporting framework 12 which has vertical side walls 14 and 15 and which framework 12 incorporates a receptacle 16 for holding a stack of empty envelopes 18 (not shown in FIG. 2).

The receptacle 16 is bounded by the side walls 14 and 15 and by vertical front and rear walls 20 and 22, extending between the side walls 14 and 15. Typically, the envelopes 18 are between 203 millimeters and 254 millimeters in length and between 99 millimeters and 111 millimeters in width, and are held loosely between the side walls 14 and 15 and between the front and rear walls 20 and 22 with the long dimension of each envelope extending parallel to the side walls 14 and 15. The stack of envelopes 18 is supported by a horizontal support plate 24 secured to the framework 12 and by the upper, horizontally extending portions of a pair of endless feed belts 26, these portions being positioned approximately 0.5 millimeter above an additional horizontal plate 28 which is also secured to the framework 12. As seen in FIG. 1, the upper portions of the belts 26 are slightly higher than the support plate 24 so that the weight of the stack of envelopes 18 is mainly supported by the belts 26. There is an opening 29 about 5 or 6 millimeters deep between the upper portions of the belts 26 and the lower edge of the front wall 20 of the receptacle 16, so as to enable the lowermost envelope 18' in the stack to be fed forwardly (from left to right with reference to FIG. 1) by the belts 26 from the receptacle 16 through the opening 29. Two inclined fingers 30 are resiliently attached to the front wall 20 and project forwardly and downwardly from the lower edge of the wall 20 for a purpose which will be described later, the fingers 30 being respectively mounted adjacent the two belts 26 with the free ends of the fingers 30 being disposed between the upper portions of the belts 26 when the spring fingers 30 are in their untensioned state.

The belts 26 respectively pass around two front pulleys 32 and around two rear pulleys 34. The front pulleys 32 are secured on a drive shaft 36 extending between, and rotatably mounted with respect to, the side walls 14 and 15, and the rear pulleys 34 are mounted on an additional shaft 38 extending between, and rotatably mounted with respect to, the side walls 14 and 15. One of the rear pulleys 34 is secured to the shaft 38 so that when the feed belts 26 are driven, the shaft 38 is caused to rotate. A silicone rubber roller 39, having a coefficient of friction greater than that of the feed belts 26, is secured on the shaft 38 between the belts 26. The roller 39 has a diameter slightly greater than that of the pulleys 34, the periphery of the roller 39 projecting slightly above the upper surfaces of the belts 26 so as to engage with the lowermost envelope 18' in the stack.

The drive shaft 36 is driven via a gear train 40 (FIG. 2) by a bidirectional electric motor 42 (FIG. 1) mounted on the framework 12. The gear train 40 is also arranged to drive an additional drive shaft 44 which is positioned immediately above the drive shaft 36 and which also extends between, and is rotatably mounted with respect to, the side walls 14 and 15. A rubber separation roller 46, whose function will be described later, is secured on a central portion of the drive shaft 44 between the feed belts 26. The periphery of the separation roller 46 is spaced approximately 2 or 4 millimeters above a support strip 48 which is integral with and projects forwardly from, the plate 28, the strip 48 being disposed between the belts 26 and extending a short distance beyond the front ends of the belts 26. In operation, the lowermost envelope 18' in the stack is fed by the feed belts 26 over the support strip 48 along a feed path 49 until the leading edge of the envelope 18' projects through an exit slot 50 formed in the user console 11, as shown in FIG. 3, the leading edge of the envelope 18' being guided into the slot 50 by molded guide means 52 provided on the inner surface of the console.

Figure 3:
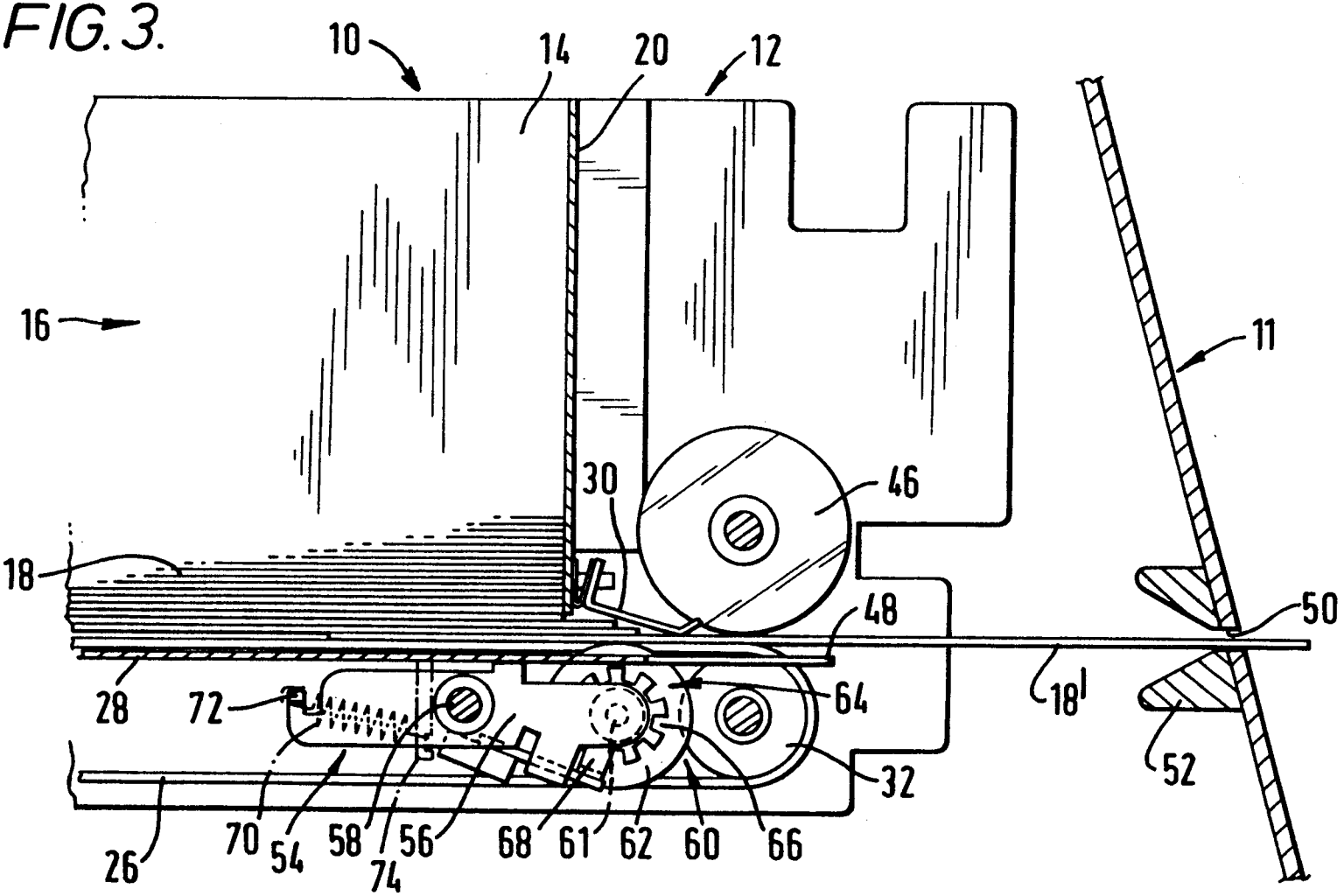
FIG. 3 is an enlarged, side elevational view of part of the apparatus of FIG. 1 showing a pulse generation mechanism.
Figure 4:
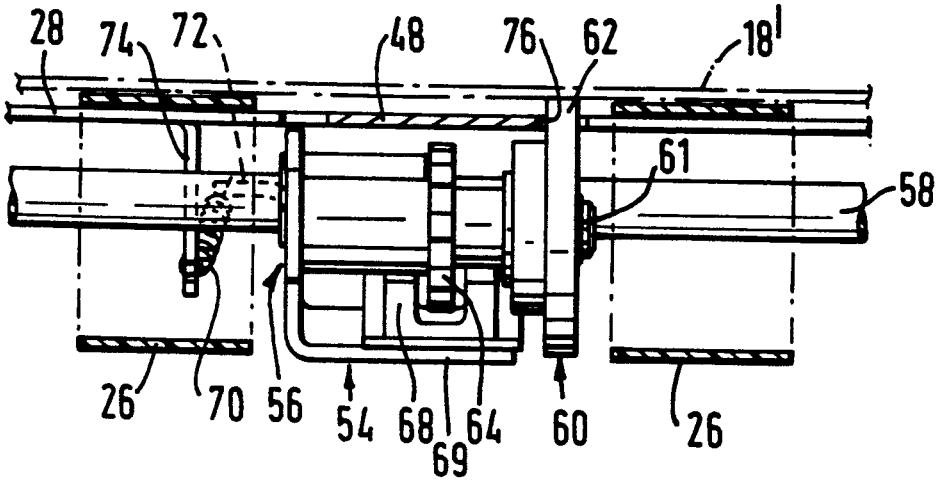
FIG. 4 is a front elevational view of the pulse generating mechanism and associated parts of the envelope dispensing module.

Referring now particularly to FIGS. 3 and 4, the envelope dispensing module 10 includes a pulse generating mechanism 54. The mechanism 54 includes a support arm 56 pivotally mounted on a shaft 58 which extends between the side walls 14 and 15, with the shaft 58 passing between the upper and lower portions of the belts 26. A roller assembly 60 is rotatably mounted on a stud 61 secured to a front end portion of the arm 56. The roller assembly 60 includes a neoprene roller 62 and an opaque plastic timing disc 64 which rotate together with the roller 62, the timing disc 64 being provided with a series of notches 66 disposed at equal intervals around the periphery of the disc 64. An optical sensor 68 is mounted on a bracket 69 formed integrally with the arm 56. The sensor 68 is mounted in cooperative relationship with respect to timing disc 64 such that, in operation, as the roller assembly 60 rotates, the sensor 68 generates a series of pulses, successive pulses being spaced apart by a time equal to a fixed angular rotation of the roller assembly 60. The support arm 56 is biased to rotate in a counterclockwise direction with reference to FIG. 3 by means of a tension spring 70, the ends of which are respectively attached to a lug 72 on the rear end of the arm 56 and to a post 74 secured to the underside of the plate 28. The periphery of the roller 62 projects through a slot 76 (FIG. 4) in the plate 28 so that, in operation, as shown in FIG. 3, the roller 62 is urged by the spring 70 into engagement with the underside of the lowermost envelope 18' after the envelope 18' has been moved partially out of the receptacle 16. By virtue of the engagement of the roller 62 with the envelope 18', movement of the envelope 18' along the feed path 49 (FIG. 1) brings about a rotation of the roller assembly 60, which in turn, causes a series of pules to be generated by the sensor 68.

Further optical sensing means 78 (FIG. 5) are mounted in the framework 12 between the end of the support strip 48 and the user console 11, the sensing means 78 being centrally located with respect to the side walls 14 and 15. The sensing means 78 serve to sense whether or not the envelope 18' is blocking the sensor line of sight 80 (FIG. 11). Thus, the sensing means 78 sense, in operation, the movement of the leading edge of the envelope 18' past a predetermined location represented by the line of sight 80.

Third optical sensing means 82 (FIG. 5) are mounted on the side walls 14 and 15 of the receptacle 16. The line of sight 84 (FIG. 2) of the optical sensing means 82 passes through slots 86 (FIG. 1) in the side walls 14 and 15. When the line of sight 84 ceases to be blocked by envelopes 18 in the receptacle 16, the sensing means 82 provide a signal indicative that the number of envelopes 18 in the receptacle 16 has fallen to a predetermined low level (typically less than 50 envelopes) and that therefore the module 10 requires replenishment with an additional supply of blank envelopes.

Figure 5:
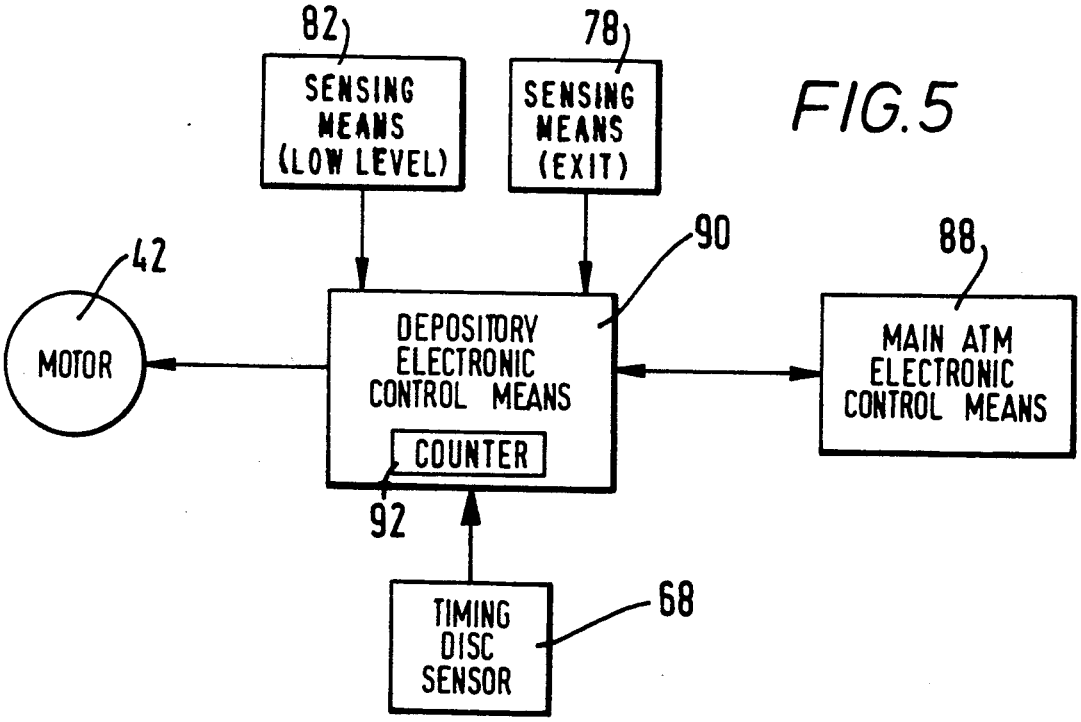
FIG. 5 is a schematic block diagram illustrating the electrical interconnections of parts of the dispensing apparatus.

The operation of the envelope dispensing module 10 will now be described with additional reference to FIG. 5. The dispensing of an envelope by the module 10 takes place as part of a money deposit operation in which an envelope is first dispensed to a customer via the exit slot 50 and then, after the customer has placed money inside the envelope, the envelope is inserted by the customer into a separate slot (not shown) in the user console 11 from where the envelope is conveyed to a deposited envelope container (not shown) in the depository. Prior to the money deposit operation being initiated, the motor 42 is in a deactivated condition. The money deposit operation is initiated by the customer inserting a customer identifying card into a card entry slot (not shown) in the user console 11 and entering appropriate data upon keyboard means (not shown) also included in the user console 11. After the entered data has been verified by main electronic control means 88 of the ATM, the control means 88 send an enabling signal to electronic control means 90 included in the depository, the depository control means 90, thereupon, causing the motor 42 to become activated.

Activation of the motor 42 causes the drive shaft 36 to be rotated in a clockwise direction (with reference to FIG. 1) so as to bring about feeding movement of the feed belts 26 which in turn brings about clockwise rotation of the silicone rubber roller 39 mounted on the rear shaft 38. At the same time, the gear train 40 brings about clockwise rotation of the separation roller 46. Since the separation roller 46 is disposed above the plane containing the uppermost surfaces of the feed belts 26, the lowermost part of the periphery of the roller 46 moves in a direction opposite to the direction of movement of the uppermost surfaces of the belts 26. The movement of the uppermost surfaces of the belts 26 together with the rotational movement of the frictional roller 39 cause the lowermost envelope 18' to be moved forwardly in the module 10 with the leading edge of the envelope 18' passing under the lower edge of the front wall 20 of the receptacle 16. As the lowermost envelope 18' commences to move forwardly out of the receptacle 16, there is a tendency for one or more of the envelopes immediately above the lowermost envelope 18' also to commence the move forwardly out of the receptacle 16 together with the envelope 18'. The resiliently mounted fingers 30 help to prevent any envelope other than the lowermost envelope 18' from reaching the separation roller 46, and also assist in the feeding movement of the lowermost envelope 18' towards the exit slot 50 by resiliently pressing this envelope 18' against the uppermost surfaces of the feed belts 26. Also, the fingers 30 act in opposed relationship with respect to the roller 62 so as to press the envelope 18' resiliently against the roller 62 and thereby ensure that the roller 62 is caused to rotate by the feeding movement of the envelope 18'. If more than one envelope should reach the separation roller 46, then normally the reverse movement of the lowermost part of the periphery of the roller 46 will serve to prevent any envelope other than the lowermost envelope 18' being fed past the roller 46 towards the exit slot 50.

Upon the leading edge of the envelope 18' intercepting the line of sight 80 of the sensing means 78, the sensing means 78 send a signal to the electronic control means 90 which cause a counter 92 included in the control means 90 to commence counting the pulses applied to the control means 90 by the timing disc sensor 68. As soon as the counter 92 has counted a predetermined number of pulses from the sensor 68, the control means 90 deactivate the motor 42 so as to stop the feeding movement of the envelope 18' brought about by the feed belts 26. The envelope 18' now projects partly through the exit slot 50, as shown in FIG. 3, and is in the correct position for removal by the customer. With the envelope 18' in its correctly presented position ready for removal by the customer, the envelope 18' continues to block the line of sight 80. Upon the customer removing the envelope 18', the line of sight 80 becomes unblocked and the sensing means 78 send a signal to the control means 90 indicative of the fact that the envelope 18' has been removed. Also, the act of withdrawing the envelope 18' by the customer causes additional pulses to be generated by the timing disc sensor 68 and to be applied to the control means 90, these additional pulses serving a useful purpose as will be explained later. If the customer fails to remove the envelope within a predetermined time (typically 15 seconds) so that the line of sight 80 remains blocked, then the control means 90 activate the motor 42 in the reverse sense so as to cause the feed belts 26 to withdraw the envelope 18' back into its original position inside the receptacle 16. The control means 90 deactivate the motor 42, so as to stop the reverse operation of the feed belts 26, when the counter 92 has counted a predetermined number of pulses after the envelope 18' has ceased to block the line of sight 80.

It should be understood that during the feeding of the envelope 18' to the exit slot 50, since the roller 62 of the pulse generating mechanism 54 engages directly the envelope 18', then after the counter 92 has counted a predetermined number of pulses as mentioned above, the envelope 18' will be in its correctly presented position even though some slippage may have occurred between the envelope 18' and the feed belts 26. Thus, there is a significant advantage in arranging that the roller assembly 60 incorporating the timing disc 64 be driven directly by the lowermost envelope 18' as opposed to an arrangement in which the timing disc 64 is driven directly by the gear train 40.

Moreover, the dispensing module 10 described above enables the ATM to recognize different types of envelope misfeed situations. For example, two overlapping envelopes may be fed partly out of the receptacle 16 towards the exit slot 50 such that when the lowermost envelope 18' is stopped in its correctly presented position, the other envelope has not reached the exit slot 50 but is blocking the line of sight 80. Such a misfeed is referred to as a short double feed. In the event of a short double feed occurring, and after the customer has removed the correctly presented envelope 18', the line of sight 80 remains blocked. However, by virtue of the fact that further pulses are fed to the control means 90 by the timing disc sensor 68 during the removal of the envelope 18' by the customer, the control means 90 recognize that the envelope 18' has been removed by the customer and further recognize that a double feed has taken place because the line of sight 80 remains blocked. Accordingly, a predetermined time after the generation of pulses by the sensor 68 has ceased, the control means 90 activate the motor 42 in the reverse sense so as to cause the other one of the overlapping envelopes to be returned to the receptacle 16. At the same time, the control means 90 send a signal to the main control means 88 of the ATM indicative of the fact that a short double feed has taken place. It is important that the main control means 88 are advised that a short double feed has taken place since a high incidence of such misfeeds could indicate that the feed belts 26 are worn and require replacement. If the main control means 88 ascertain that there is high incidence of short double feeds, then the control means 88 provide an indication to the financial institution where the ATM is located that appropriate maintenance action needs to be taken.

Another type of misfeed which may occur is a long double feed in which two overlapping envelopes are fed partly out of the receptacle 16 so that they both project through the exit slot 50. After the motor 42 has been stopped with the lowermost envelope 18' in its correctly presented position, the counter 92 counts the number of additional pulses which are generated by the timing disc sensor 68 during the removal of the presented envelope or envelopes from the slot 50 by the customer. In the event of the customer failing to remove either of the presented envelopes, then the line of sight 80 remains blocked, and after a predetermined time, the control means 90 activate the motor 42 in the reverse sense so as to cause both envelopes to be withdrawn back into their original positions in the receptacle 16. Alternatively, if the customer removes just one of the two presented envelopes, then, again, the line of sight 80 remains blocked, and after a predetermined time, the remaining envelope is withdrawn back into the receptacle 16. By virtue of the fact that additional pulses are counted by the counter 92 during the removal of a presented envelope by the customer, the control means 90 are able to distinguish between a situation where a long double feed has taken place and only one of the two presented envelopes is removed, the other envelope being withdrawn back into the receptacle 16, and a situation where a single envelope is presented and then withdrawn following failure of the customer to remove this envelope. Also, the control means 90 are able to distinguish between the situations where an envelope is withdrawn back into the receptacle 16 following a long double feed (or following a short double feed) by counting, during the reverse operation of the motor 42, the number of pulses generated by the timing disc sensor 68 before the line of sight 80 becomes unblocked. Depending on the type of misfeed which has taken place, the control means 90 send an appropriate signal to the main ATM control means 88. The data provided to the control means 88 is analyzed therein, and, when necessary, the control means 88 provide an indication to the associated financial institution that appropriate maintenance action is required.

Thus, it will be appreciated that the envelope dispensing module 10 described above is reliable in operation, and also provides a means of recognizing that different types of misfeeds have taken place. Further, the module 10 is of simple construction. For example, the module 10 requires only one sensing means (the sensing means 78) between the receptacle 16 and the exit slot 50.

As previously mentioned, the sensing means 82 associated with the receptacle 16 are arranged to provide a signal indicative that the number of envelopes 18 in the receptacle 16 has fallen to a predetermined low level, such signal being applied to the depository control means 90. Upon receipt of such signal, the control means 90 send an appropriate signal to the main ATM control means 88 which provide an indication to the associated financial institution that the envelope dispensing module 10 requires replenishment.

What is claimed is:

1. An apparatus for dispensing flat articles, comprising:

a storage bin for storing said flat articles, and an exit location;

a feed path between said storage bin and said exit location;

feed means for feeding said articles, one by one, along said feed path to said exit location;

roller means, including a roller for engaging a said flat article as said flat articles is moved along said feed path;

pulse generating means, including said roller means to generate a series of successive pulses in response to rotation of said roller, said successive pulses being spaced apart by a time substantially equal to a predetermined angular rotation of said roller;

sensing means for sensing the passage of a leading edge of a said article past a predetermined location in said feed path; and control means for stopping the feeding of said flat article in response to the generation by said pulse generating means of a predetermined number of pulses subsequent to the sensing of the passage of said leading edge by said sensing means;

said control means being effective for operating said feed means in a reverse direction for feeding said flat article from said exit location towards said storage bin after said flat article has remained a predetermined amount of time at said exit location.

2. The apparatus as claimed in claim 1 in which said pulse generating means includes:

a timing disc coupled to said roller to rotate therewith; and second sensing means operatively coupled to said timing disc to generate said series of successive pulses in response to the rotation of said timing disc.

3. The apparatus as claimed in claim 1 in which said flat article has an upwardly facing surface and a downwardly facing surface, and in which said apparatus includes a resilient means for resiliently urging said roller into engagement with said downwardly facing surface of said flat article.

4. The apparatus as claimed in claim 3 in which said apparatus includes flexible engagement means for engaging said upwardly facing surface of said flat article as said flat article is moved along said feed path, said flexible engagement means acting in opposed relationship to said roller.

5. The apparatus as claimed in claim 4 in which said feeding means includes first and second endless feed belts which are spaced apart in parallel relationship, with said first and second endless feed belts having upper portions which engage said downwardly facing surface of said flat article as said flat article is moved along said feed path; and said roller being positioned between said upper portions of said first and second endless feed belts to engage said downwardly facing surface of said flat article.

6. The apparatus as claimed in claim 5 in which said storage bin has an exit slot therein and in which said first and second endless belts are positioned below said storage bin so as to engage a lower-most one of said flat articles in said storage bin via the upper portions of said first and second endless feed belts.

7. The apparatus as-claimed in claim 6 in which said roller means includes a stripper roller positioned between said storage bin and said exit location to inhibit the passage of more than one of said flat articles towards said exit location.

8. The apparatus as claimed in claim 1 in which said apparatus includes an indicator coupled to said control means to indicate when the number of flat articles in said storage bin has reached a predetermined number.

9. An apparatus for dispensing flat articles comprising:

a storage bin for storing said flat articles, and an exit location;

a feed path between said storage bin and said exit location;

feed means for feeding said articles, one by one, along said feed path to said to said exit location;

roller means, including a roller for engaging a said flat articles as said flat article is moved along said feed path;

pulse generating means, including said roller means to generate a series of successive pulses in response to rotation of said roller, said successive pulses being spaced apart by a time substantially equal to a predetermined angular rotation of said roller;

sensing means for sensing the passage of a leading edge of said flat articles past a predetermined location in said feed path; and control means for stopping the feeding of said flat article in response to the generation by said pulse generating means of a predetermined number of pulses subsequent to the sensing of the passage of said leading edge by said sensing means;

said flat article having an upwardly facing surface and a downwardly facing surface, and in which said apparatus includes a resilient means for resiliently urging said roller into engagement with said downwardly facing surface of said flat article;

said apparatus including flexible engagement means for engaging said upwardly facing surface of said flat article as said flat article is moved along said feed path, said flexible engagement means acting in opposed relationship to said roller;

said feeding means including first and second endless feed belts which are spaced apart in parallel relationship, with said first and second endless feed belts having upper portions which engage said downwardly facing surface of said flat article as said flat article is moved along said feed path; and said roller being positioned between said upper portions of said first and second endless feed belts to engage said downwardly facing surface of said flat article;

said storage bin having an exit slot therein and in which said first and second endless belts are positioned below said storage bin so as to engage a lower-most one of said flat articles in said storage bin via the upper portions of said first and second endless feed belts;

said roller means including a stripper roller positioned between said storage bin and said exit location to inhibit the passage of more than one of said flat articles towards said exit location;

said apparatus including an indicator coupled to said control means to indicate when the number of flat articles in said storage bin has reached a predetermined number; and said feeding means being controlled by said control means to operate in a reverse direction for feeding said flat article from said exit location towards said storage bin after a predetermined amount of time at said exit location, and in which said control means includes a counter for counting said successive pulses in response to movement of said flat article in either direction along said feed path.

10. A method of dispensing envelopes from a storage bin to an exit slot in an (ATM), automated teller machine (ATM) said method comprising the steps of:

(a) positioning a timing disc means between a storage bin and an exit slot for monitoring the movement of an envelope along a feed path from said storage bin to said exit slot;

(b) using a roller included in said timing disc means for engaging said envelope to generate successive pulses indicative of the movement of said envelope along said feed path;

(c) stopping the movement of said envelope at said exit slot after a predetermined number of said successive pulse so as to enable the leading edge of said envelope to extend out of said slot for grasping by a user of said ATM: and (d) withdrawing said envelope into said ATM if said envelope is not pulled out of said ATM after a predetermined amount of elapsed time.

11. In a business machine, a combination comprising:

a panel having an exit slot therein;

a storage bin for storing flat articles to be dispensed, one by one, through said exit slot;

a feed path between said storage bin and said exit slot;

bi-directional feed means for moving said flat articles between said storage bin and said exit slot;

pulse generating means including a roller for engaging a said flat article as it is moved from said storage bin to said exit slot and for generating a series of successive pulses in response to rotation of said roller as said flat article is moved;

sensing means for sensing the passage of a leading edge of said flat articles past a predetermined location in said feed path; and control means coupled to said feed means, said pulse generating means, and said sensing means for:

stopping the movement of said flat article in response to the generation by said pulse generating means of a predetermined number of pulses subsequent to the sensing of the passage of said leading edge past said predetermined location by said sensing means; and operating said bi-directional feed means in a reverse direction for feeding said flat article from said exit location towards said storage bin after a predetermined amount of time at said exit location.

12. The combination as claimed in claim 11 in which said control means has means has a counter for counting pulses from said pulse generating means when said bi-directional feed means moves said flat articles between said storage bin and said exit slot for handling overlapping first and second said flat articles.

* * * * *

UNITED STATES PATENT AND TRADEMARK OFFICE

CERTIFICATE OF CORRECTION

PATENT NO. : 5,238,143

DATED : August 24, 1993

INVENTOR(S) : Adam J. Crighton

It is certified that error appears in the above-identified patent and that said Letters Patent is hereby corrected as shown below:

Column 7, line 59 , "articles" should be --article--.

Column 8, line 48, between "as" and "claimed" delete -- - --.

Column 8, line 66, "articles" should be --article--.

Column 9, line 7, "articles" should be --article--.

Column 10, line 4, delete "(ATM),".

Column 10, line 18, after "ATM" delete ":" and insert --;--.

Column 10, line 35, "articles" should be --article--.

Signed and Sealed this

Fifteenth Day of March, 1994

*Attest:*

*Attesting Officer*

BRUCE LEHMAN

*Commissioner of Patents and Trademarks*